United States Patent [19]

Fyfe

[11] 4,111,584

[45] Sep. 5, 1978

[54] EXPANSION JOINTS SEAL ASSEMBLY

[75] Inventor: Edward Fyfe, Burlington, Canada

[73] Assignee: Elastometal Limited, Burlington, Canada

[21] Appl. No.: 526,682

[22] Filed: Nov. 25, 1974

[51] Int. Cl.[2] ..... E01C 11/02

[52] U.S. Cl. ..... 404/69; 52/396

[58] Field of Search ..... 404/68, 69, 65, 57, 404/47; 52/396, 403, 468

[56] References Cited

U.S. PATENT DOCUMENTS

| | | | |
|---|---|---|---|
| 3,068,763 | 12/1962 | Harza | 404/67 |
| 3,363,383 | 1/1968 | La Barge | 404/68 X |
| 3,570,378 | 3/1971 | Honegger | 404/69 |
| 3,605,586 | 9/1971 | Bowman | 404/68 |
| 3,626,822 | 12/1971 | Koster | 404/69 |
| 3,830,539 | 11/1974 | Bowman | 404/69 |
| 3,877,829 | 4/1975 | Honegger | 404/69 |

FOREIGN PATENT DOCUMENTS

| | | | |
|---|---|---|---|
| 422,033 | 1966 | Switzerland | 404/47 |
| 896,034 | 5/1962 | United Kingdom | 404/64 |

*Primary Examiner*—Nile C. Byers, Jr.
*Attorney, Agent, or Firm*—G. James M. Shearn

[57] ABSTRACT

A seal assembly for expansion joint gaps in which a sealing member having a gap spanning portion and side walls is sealingly attached to abutments on respective sides of said gap by a clamping plate adjustably adapted to squeeze the sealing member side wall against a flange of said abutment.

12 Claims, 6 Drawing Figures

EXPANSION JOINTS SEAL ASSEMBLY

This invention relates to improvements in expansion joints for structures such as roadways and the like. More particularly it concerns expansion joints with flexible sealing elements.

The proper design of large structures such as road beds and bridges for highways, concrete walls and the like require that provision be made to accommodate expansion and contraction due to temperature changes. Usually this is done by incorporating expansion joints in the structure which provide a gap between sections of the structure and which will accommodate some relative movement due to expansion or contraction.

It is often however necessary that expansion joints include a seal capable of providing a tight barrier against wind, water and dirt, etc. Typically, for instance a roadway or bridge will be designed with intermittent expansion gaps which run transversely across the roadway. Such an expansion joint often requires a seal capable of accommodating expansion and contraction and which can be secured to the road bed on each side of the gap.

Previously known expansion joint assemblies have been expensive to manufacture and difficult to install or replace. Some designs have been subject to failure in maintaining their weather-tight seal under repeated stress of expansion and contraction movement.

It is therefore an object of this invention to provide an improved seal assembly for expansion joints which will meet the requirements of its purpose and will be easier to install, maintain, or replace.

These and other objects and advantages are achieved with this invention by providing a seal assembly for expansion joints comprising: abutments adapted to be mounted on the opposite sides of an expansion joint gap having flanges facing on said gap; a clamping plate; means for releasably attaching said plate to said flange in parrallel, adjustably-spaced relation thereto; and a resilient sealing member having a web portion spanning between side wall portions disposed substantially normal thereto, said side wall portions being receivable in said space between said flange and said plate, said plate being being adapted by said adjustable attaching means to squeeze said side wall portion against said flange in sealing relation therewith.

The features of the invention will be apparent from the following description of specific embodiments with reference to the accompanying drawing in which.

Figure 1:
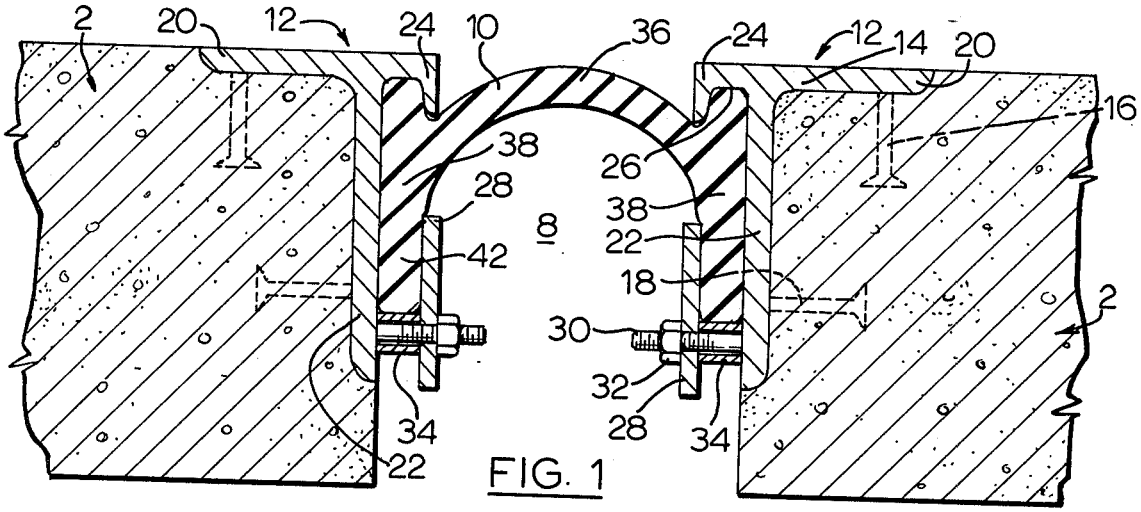
FIG. 1 is a vertical cross-section view perpendicular to the direction of the joint of one embodiment of the invention as applied to a roadway.

As illustrated in the embodiment shown in FIG. 1 the present invention is useable in expansion joints between two sections of roadway slabs illustrated generally as at 2—2 which may be on a conventional road bed or a bridge or overpass. For simplicity the roadway illustrated is composed of a single slab the top of which constitutes the travel surface of the roadway. It should be understood of course that the invention is applicable to other forms of road design such as those with a concrete slab having a traction layer of ashphalt on top.

As illustrated the gap 8 between the roadway sections is spanned and sealed by an expansion joint sealing assembly of the present invention having a flexible elastic sealing member 10 spanning between and attached to abutments 12—12, both of which conventionally extend continuously the entire length of the joint (i.e. the entire width of the roadway) and are positioned facing each other on opposite side of the gap and mounted on the sections of roadway slabs.

The pair of abutments 12—12 in the embodiment illustrated in FIG. 1 (which are mirror images of each other), have a right angle member 14 secured in place by anchors 16 and 18 embedded in the roadway, and have a horizontal portion 20, the top of which is level with the travelled surface of the roadway, and a vertical flange 22 defining the sides of the gap 8 (although they need not necessarily coincide exactly with the end of the roadway slab). At the upper end of the vertical flange an over-hanging portion 24 extends into the gap first horizontally and then downwardly thereby presenting an inverted, downwardly open channel 26.

The abutment also has a clamping plate 28 supported by and adjustably held to the vertical flange by a threaded bolt 30 protruding from the lower region of the vertical flange and extending horizontally into the gap and through corresponding holes in the lower region of the clamping plate. Such a bolt might be fusion-welded to the flange so as to provide a smooth attachment without any shoulder which might obstruct the sleeve 34.

Nut 32 threaded onto the end of the bolt 30 serves to hold the plate and to urge it in the direction of the vertical wall portion as desired. For this purpose a lock-nut might be preferred. Alternatively the plate could be attached by a bolt having its head behind the plate in the position of the nut shown in FIG. 1. In this case female threads would be required in the flange wall 22 and a recess chamber would be provided behind the flange to allow for the end of the bolt to project there through when tightened. This arrangement, although more difficult to make would occupy less space in the gap and provide greater freedom in the dimensions designed for small gaps where space is critical. A sleeve 34 fits over the bolt between the vertical wall and the plate to serve as a spacer setting the minimum spacing between them.

The sealing member 10 in the illustrated embodiment has a generally horizontally disposed web portion 36 spanning the gap of the joint between the abutments at approximately the level of the roadway surface.

Although the illustrated sealing member is arched it may be corrugated in a variety of configurations well known to those skilled in the art. Whatever the configuration, it relies on flexibility and elasticity to accommodate the relative movement of the joint due to expansion and contraction.

Figure 6:
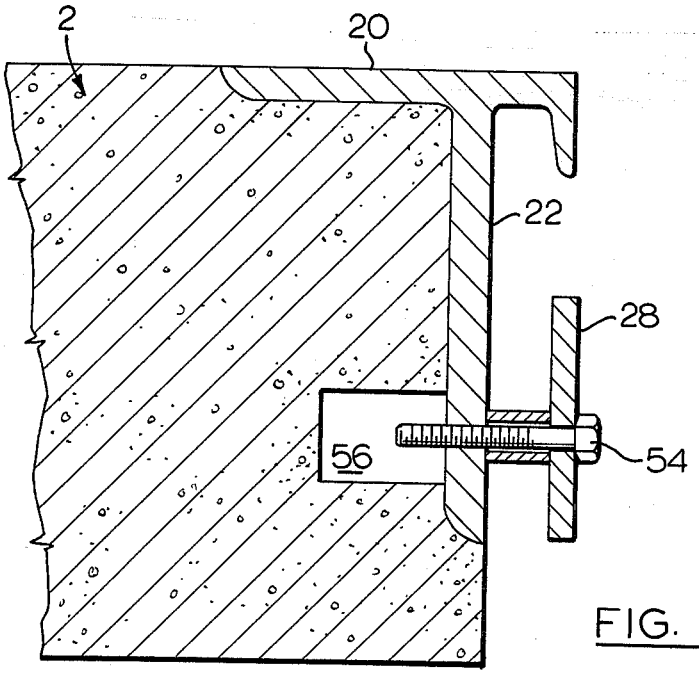
FIG. 6 is a cross-section view of another modified embodiment of the invention.

In fact, for some purposes such as roadways where incompressible material such as gravel may collect in the contours of the seal, it may be desirable to use a shape in which the web portion 36 has a generally V-shaped configuration extending downwards. In such a design it would be desirable to provide sufficient space between abutments for the groove of the seal, filled with gravel or other material, to remain un-crushed at the minimum spacing of the gap. To this end the arrangement mentioned above in which the bolt 30 and 32 were replaced by a flat-headed bolt fitting flush with or flat against the plate 28 as shown in FIG. 6 in which bolt 30 and nut 32 are replaced by a flat headed bolt 54 threadably engaging the flange 22 and extending into a prepared recess chamber 56.

To grip the sealing member and effect a seal along each side of the gap, the sealing member is provided with substantially vertically disposed side walls 38 running along each side of the web portion 36. The side walls are formed integrally with and normal to the web portion and have an upper bead 40 adapted to substantially fit the channel 26 and a downwardly extending leg 42 which occupies the space between the vertical flange and the plate above the spacer 34.

The spacer is smaller than the thickness of the side wall 38 so that tightening the bolt an appropriate amount will squeeze the downward extending leg of the side wall tending to hole it tightly and sealingly against the vertical face of the flange 22. Furthermore the squeezing effect will tend to deform the elastic material thereby urging the material upward and creating an additionally tight seal between the bead 40 and the channel 26, and in addition, assisting the holding function of the over-hanging portion 24 to prevent pulling away of the sealing member from the abutment. It will of course be realized that a series of bolts will be employed spaced at intervals along the vertical flange of the expansion joint, the spacing depending upon considerations such as the support desired for the sealing member side walls and the rigidity of the plate which must provide adequate pressure against the side walls along the entire length including the area between the bolts.

Figure 3:
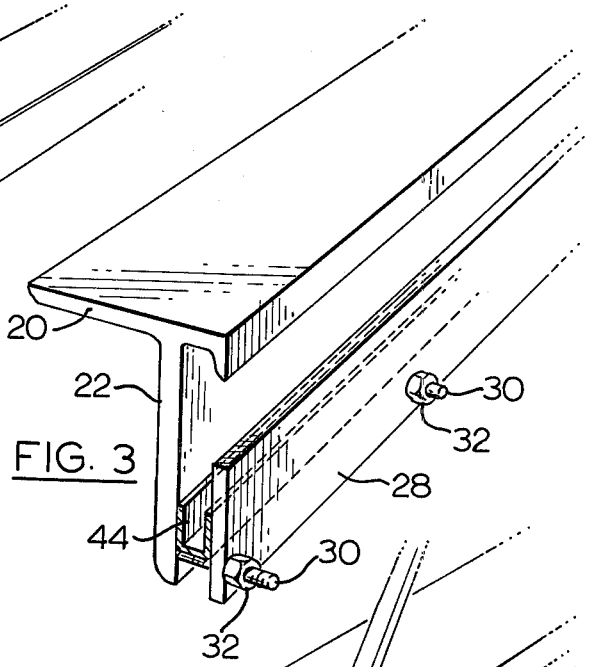
FIG. 3 is a prespective view of a modified embodiment of the expansion joint seal assembly such as shown in FIG. 1.

FIG. 3 illustrates a modification or variation of the invention in which a flexible U-shaped channel strip 44 is employed to provide a bottom for the space between the vertical flange 22 and the clamping plate 28 thus providing continuous support along the length of the seal side walls between the bolts rather than only at the bolt locations. This strip being flexible will not effect the adjustment or the tightening of the clamping plate but will serve to resist bulging of the elastic material downward in the areas between the bolt locations thus aiding in providing better sealing pressure between the top of the bead 40 and the channel 26.

Figure 4:
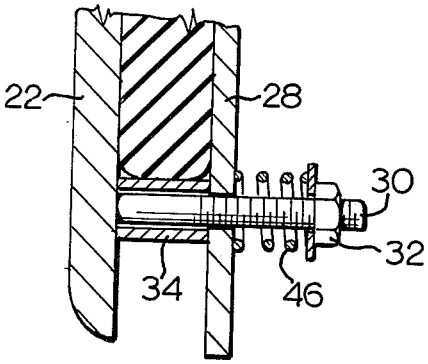
FIG. 4 is a vertical cross-section view of a modified embodiment of the invention.

FIG. 4 illustrates a further modified embodiment of the invention in which the plate 28 is spaced from the vertical flange 22 by a spacer sleeve 34 as in FIG. 1 but the plate is urged toward the vertical flange to squeeze the leg 42 by means of a spring 46 positioned on the bolt, behind the plate and held against it by the nut 32. It will be appreciated that by selecting a spring of appropriate compressive strength, the squeezing pressure exerted by the plate to seal the sealing member against the flange will be relatively constant and correct even without precise tightening or adjustment of the nut 32.

Figure 2:
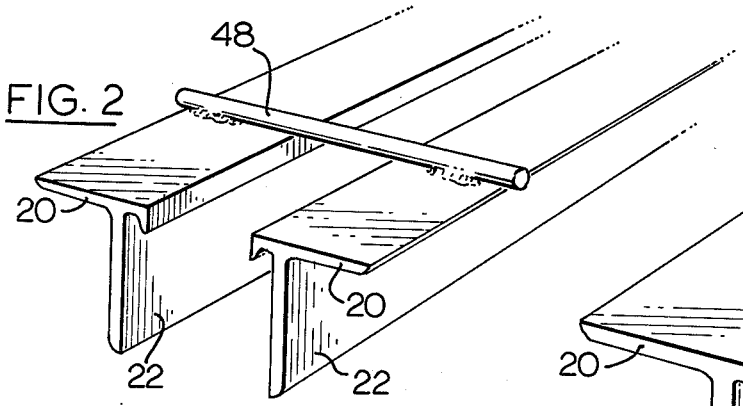
FIG. 2 is a perspective view of part of a seal assembly as in FIG. 1 joined in a pre-assembled position.

The invention is additionally advantageous for purposes of installation. If the expansion joint is to be preassembled in the shop before it is placed in position, between the adjacent slabs of the roadway for instance, the two abutment pieces 12—12 can be secured in their desired pre-determined spacing parallel to each other by cross bars, such as those illustrated as 48 in FIG. 2, temporarily spot-welded across the horizontal portion 20.

The seal can then be inserted with the plate 28 loosened (either with or without strip 40 as desired) and the seal clamped by tightening the bolts 32—32 the appropriate amount, access to the bolts being had from beneath or by assembling the joint up-side-down. The entire assembled expansion joint can then be taken to the installation location, positioned in the roadway gap and secured by whatever conventional means are intended to be used, which conventionally will include pouring concrete to embed the anchors such as 16 and 18 in the roadway. The temporary cross bars can then be removed to allow the expansion joint to function in accommodating the movement of the joint.

Where the expansion joint is to be assembled in place the abutments will usually be placed and anchored to the respective adjacent slabs on either side of the gap. The seal, which of course will have to be designed in terms of dimensions and flexibility and elasticity to span between the abutments and accommodate the maximum movement of the slabs, will then be installed in the abutment on each side of the gap.

The present invention comtemplates that this can be done by inserting one side wall along one abutment first, with the clamping plate loosened, after which access can still be had to the nuts to tighten the plate the desired amount.

Since in most field locations access will not be available from beneath, installation of the second flange of the seal will be slightly more involved. Although it might be possible to tighten the nut on the second abutment and then force the seal flange in the space between the plate and the vertical member relying on lubrication and the elasticity of the seal material, this is a difficult procedure and presents the problem that it may only be possible when the space affords a sufficiently loose fit that the desired degree of sealing pressure may not be present.

Using the adjustable clamping plate of the present invention it is possible to insert the side wall of the sealing member at one point (for instance at one end of the joint) and tighten the nuts such as 32 in turn as the insertion advances, the flexibility of the seal allowing the installer to reach the nut where the side wall has been inserted while the advanced portion of the side wall is still out of position.

Figure 5:
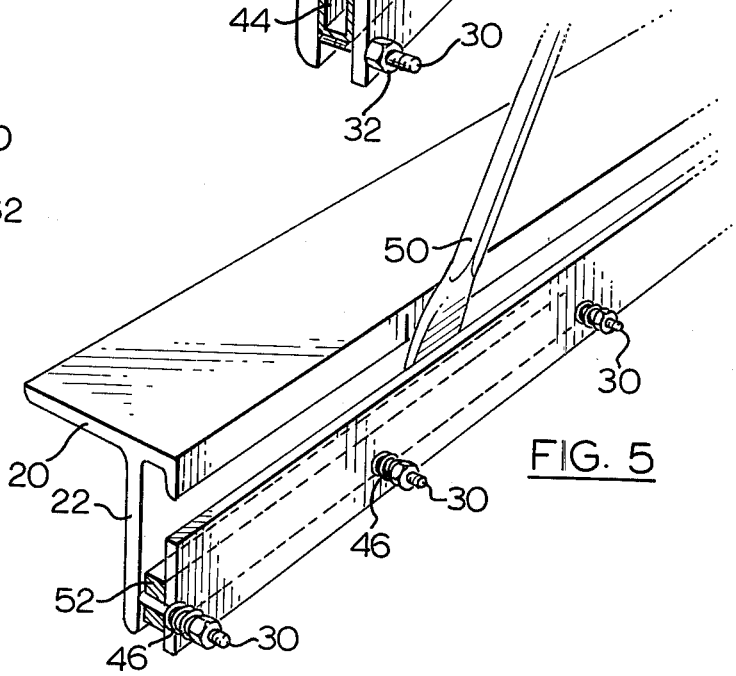
FIG. 5 is a perspective view of another modified embodiment of the invention, and illustrates, in part, installation thereof.

Alternatively, using the embodiment of FIG. 4 or FIG. 5 in which the plate is backed up by a spring or other yieldable resilient elements, the installer can pry the plate out away from the vertical flange by inserting a lever or crowbar as seen at 50 in FIG. 5, the bar being moved along in advance of the insertion of the second side wall and used to pry the plate out from the vertical flange 22 enough to insert the side wall of the seal. Upon releasing the plate the spring will urge the plate to press the side wall of the seal against the flange 22 (and also the channel 26) of the abutment.

It may on the other hand be convenient to install the seal member along both sides at the same time by starting at one end for instance and inserting the side wall portion between the plate and flange in each abutment progressively along the length of the joint. This approach may be used either with the embodiment of FIGS. 4 and 5 or by the technique of tightening the nuts 32—32 progressively as the seal insertion progresses in the manner previously mentioned.

Arrangement of the bolts 30—30 at staggered spacing on respective sides of the gap will allow greater leeway in the length of the bolt and the dimensions of the abutment assembly relative to the dimension of the gap.

It should also be realized that the over-hanging portion 24 of the abutment may be of a variety of shapes, or may in some cases be absent although some advantage may thereby be lost, but should preferably provide an upper barrier against which the upper bead of the seal side wall will be pressed by the squeezing effect of the clamping plate. It will preferably have an additional downward projection, such as illustrated in FIG. 1, by which forces tending to pull the seal away from the abutment will be resisted.

FIG. 5 illustrates a further modification of the invention in which the spacer, which sets the minimum spacing of the plate from the flange 22, is provided by an elongated bar 52 running parallel to and between the flange and the plate and having a series of holes through which the bolts 30—30 extend. Such a bar provides both the spacer function and the function of supporting the underside of the side wall 42 continuously along the length of the joint in a manner similar to the strip 44 illustrated in FIG. 3. In fact upright walls on the bar 52 or a strip such as 44 might be used in conjunction with the bar 52 to prevent the elastic seal material from being pinched between the plate and the bar and the flange when the bolts are being lightened.

Some conventional designs for expansion joints employ a lubricant-adhesive gel-like substance which lubricates the seal material as it is being inserted into a fixed groove or channel member and acts as an adhesive to bond the seal member to the channel member. This technique however creates some problems in removing or replacing a seal and, although it may be used where desired it is for most cases made unnecessary by the present invention.

While the illustrated embodiment describes a single seal member, the invention is also adaptable to the expansion joint in which the gap is too great to be effectively spanned by a single seal such as shown in FIG. 1. Such larger joints conventionally use one or more intermediate beam members running along the gap between the sides so that two or more seals may be used spanning from one side to the beam and from the beam to the other side respectively. Since these beam members are conventionally supported by cross-members running transversely underneath the joint would merely require abutments such as shown in FIG. 1 to employ the present invention.

Although the description of illustrative embodiments herein being referred to as horizontally disposed seals spanning between vertical flanges of a horizontally spaced gap, it will be realized that this invention may be equally useful in expansion joints in vertical or inclined structures, or or even non-aligned sections of a structure, and is not limited to horizontal roadway slabs illustrated. The relative position, shapes and functions of the elements of the invention would remain essentially the same.

Although the foregoing descriptions illustrate preferred embodiments additional varied and modified versions of the invention may be employed without departing from the inventive concept.

What I claim as new and desire to protect by Letters Patent of the United States is:

1. A seal assembly for expansion joints in which the sides of a gap are defined by the edges of two confronting sections of a structure such as a roadway slab or the like, comprising in combination:

at least one abutment adapted to be mounted on said confronting sections along respective sides of said gap and having a substantially vertical flange facing across said gap;

a clamping plate adapted to extend along said seal assembly parallel to said flange;

means releasably attaching said plate to said flange in parallel adjustably spaced relationship thereto;

a flexible sealing member of elastic material having a web portion spanning between side wall portions disposed substantially normal thereto, and substantially parallel to said flange;

said side wall portions being receivable in said space between said flange face and said plate, and said plate being adjustable by said attaching means to squeeze said side wall portion against said flange face in sealing relation therewith;

said attaching means comprising bolt means extending between said plate and said flange substantially normal thereto;

said adjustable attaching means including a yieldable resilient element adapted to urge said plate to press against said side wall.

2. A seal assembly as claimed in claim 1 in which said attaching means includes a bolt extending horizontally from said flange and a nut threadably mounted on said bolt adapted to urge said plate towards said flange, and includes a yieldable resilient element between said plate and said nut.

3. A seal assembly as claimed in claim 2 in which said attaching means includes a bolt extending from the lower region of said vertical flange to pass through a corresponding aperture in the lower portion of said plate, and includes a spacer between said flange and said plate;

which spacer comprises a sleeve mounted concentrically on said bolt between said flange and said plate.

4. A seal assembly as claimed in claim 1 in which said yieldable resilient element is a helical spring.

5. A seal assembly as claimed in claim 2 in which said yieldable resilient element is a helical spring.

6. A seal assembly as claimed in claim 3 in which said yieldable resilient element is a helical spring.

7. A seal assembly as claimed in claim 1 including an overhanging portion extending from the upper part of the flange presenting a channel adapted to receive the upper edge of said side wall, and in which said web of said seal is attached to said side wall at a point spaced from said upper edge.

8. A seal assembly as claimed in claim 1 including a flexible upwardly open U-shaped side wall support strip extending along said space between said flange and said plate overlying said attaching means and underlying said side wall.

9. A seal assembly for expansion joints in which the sides of a gap are defined by the edges of two confronting sections of a structure such as a roadway slab or the like, comprising in combination:

at least one abutment adapted to be mounted on said confronting sections along respective sides of said gap and having a substantially vertical flange facing across said gap;

a clamping plate adapted to extend along said seal assembly parallel to said flange;

means releasably attaching said plate to said flange in parallel adjustably spaced relationship thereto;

a flexible sealing member of elastic material having a web portion spanning between side wall portions disposed substantially normal thereto, and substantially parallel to said flange;

said side wall portions being receivable in said space between said flange face and said plate, and said plate being adjustable by said attaching means to squeeze said side wall portion against said flange face in sealing relation therewith;

said attaching means comprising bolt means extending between said plate and said flange substantially normal thereto;

a flexible upwardly open U-shaped side wall support strip extending along said space between said flange and said plate overlying said attaching means and underlying said side wall.

10. A seal assembly as claimed in claim 9 in which said attaching means includes a bolt extending horizontally from said flange and a nut threadably mounted on said bolt adapted to urge said plate towards said flange.

11. A seal assembly as claimed in claim 10 in which said attaching means includes a bolt extending horizontally from the lower region of said vertical flange to pass through a corresponding aperture in the lower portion of said plate, and includes a spacer between said flange and said plate; which spacer comprises a sleeve mounted concentrically on said bolt between said flange and said plate.

12. A seal assmebly as claimed in claim 8 including an overhanging portion extending from the upper part of the flange presenting a channel adapted to receive the upper edge of said side wall, and in which said web of said seal is attached to said side wall at a point spaced from said upper edge.

* * * * *